US006142596A

United States Patent [19]

Carson

[11] Patent Number: 6,142,596

[45] Date of Patent: Nov. 7, 2000

[54] UNDER MOUNT DRAWER SLIDE

[75] Inventor: Sharon M. Carson, Zeeland, Mich.

[73] Assignee: Knape & Vogt Manufacturing, Co., Grand Rapids, Mich.

[21] Appl. No.: 09/137,274

[22] Filed: Aug. 20, 1998

[51] Int. Cl.[7] ..... A47B 88/00

[52] U.S. Cl. ..... 312/334.39; 312/334.27; 312/330.1

[58] Field of Search ..... 312/334.1, 330.1, 312/334.14, 334.27, 334.29, 334.31, 334.36, 334.39, 334.41

[56] References Cited

U.S. PATENT DOCUMENTS

| | | | |
|---|---|---|---|
| 855,037 | 5/1907 | Amberg | 312/334.39 |
| 1,315,922 | 9/1919 | Franklin . | |
| 1,321,167 | 11/1919 | Voigt . | |
| 2,162,318 | 6/1939 | Schmitz | 312/334.33 |
| 3,387,907 | 6/1968 | Wall . | |
| 3,658,399 | 4/1972 | Vogt | 312/333 X |
| 4,141,525 | 2/1979 | Miller . | |
| 4,176,890 | 12/1979 | Gorton . | |
| 4,305,625 | 12/1981 | Gutner et al. | 312/330.1 X |
| 4,387,942 | 6/1983 | Lense . | |
| 4,458,964 | 7/1984 | Hardy | 312/330.1 |
| 4,465,324 | 8/1984 | Röck et al. | 312/334.39 X |
| 4,752,143 | 6/1988 | Lautenschläger, Jr. | 312/334.39 X |
| 4,759,341 | 7/1988 | McFarland . | |
| 4,881,826 | 11/1989 | Grass . | |
| 5,275,483 | 1/1994 | Rasmussen | 312/334.41 |
| 5,641,216 | 6/1997 | Grass | 312/334.27 |

*Primary Examiner*—Peter M. Cuomo
*Assistant Examiner*—James O. Hansen
*Attorney, Agent, or Firm*—Van Dyke, Gardner, Linn & Burkhart, LLP

[57] ABSTRACT

An under mounted drawer slide assembly with a cabinet channel and drawer slide that interface so as to avoid the necessity of creating an opening in the lower portion of the drawer's rear panel. A bracket for the drawer slide is formed to fit around the lower edge of the drawer's rear panel and includes an elongated roller mounted thereto at a height below the lower edges of the drawer panels. The roller has a smaller diameter than conventional rollers but is elongated to provide greater support and stability to the drawer slide system. This roller travels within a generally C-shaped channel that is also located beneath the lower edges of the drawer panels. Both the roller and channel are low profile components so as to fit within the tight space constraints between the lower edges of the drawer and the cabinet opening, thereby avoiding having to mount the channel and slide within the recess created by the bottom panel of the drawer.

14 Claims, 5 Drawing Sheets

UNDER MOUNT DRAWER SLIDE

BACKGROUND OF THE INVENTION

This invention relates generally to drawer slide assemblies for guiding and supporting a drawer within a cabinet or other form of framed enclosure, and more particularly to under mounted drawer slide assemblies.

Historically, many drawer slide assemblies have been side mounted systems, which are mounted in the gap between the drawer sidewall and casement. Side mounted systems entail securing a drawer slide onto each side of the drawer, with each drawer slide mating with a cabinet slide or channel secured within the cabinet. The cabinet channel then cooperates with the drawer slide to guide and support the drawer as it is inserted into and withdrawn from the cabinet. Although such a system is functionally acceptable, it requires a very narrow roller to support the drawer due to the very confined lateral space between the drawer and the opening in the cabinet. Furthermore, when the drawer is withdrawn, the slides are visible from the side and this visibility detracts from the appearance of the cabinet or furniture.

An alternative system that improves the appearance of the arrangement by concealment of the slide system is the under-mounted monorail drawer slide. This system includes a single component that is attached to the middle underside of the drawer and extends longitudinally beneath the drawer. The cabinet then has a single corresponding component that cooperates with the drawer component to guide and support the drawer. Although such an under-mount approach provides a system that is virtually invisible when the drawer is open, in the past such systems have generally not been robust systems and could not withstand the weight or side loads that can be handled by a side mounted system. Furthermore, due to vertical space constraints, an under-mounted monorail system does not have a roller in a track but rather entails smaller bearings within a plastic casing or simply a guide that slides along the track with no roller or bearings. This results in a drawer that does not slide in and out of the cabinet in a smooth, effortless, quiet, and therefore desirable manner.

In an effort to further improve upon the monorail system, double track under-mounted systems have more recently been developed. These systems also solve the problem of unsightly visible components when the drawer is open, and have further been developed to provide smooth movement of the drawer. However, in order to manufacture and assemble such devices, additional steps in both the manufacturing and assembly processes are required. Due to the minimal space available underneath the drawer, these slide and channel systems require that the slide component be installed laterally adjacent the channel component. This has resulted in more complex drawer slides that require additional flanges and extensions to laterally interface with the corresponding cabinet channels and vice versa. Because of this approach, not only are the components more complex and thus more expensive to manufacture, but the end result of attempting to match up the components next to each other is a drawer system that has excessive play and thus rattles more than a conventional side mount system.

The bottom surface of most drawers are actually recessed a predetermined height, typically between 0.375 and 0.5 inches, above the lower edge of the side panels of the drawer. In order to provide enough clearance for the components, without creating a large and therefore noticeable gap between the bottom of the drawer and the cabinet frame, the drawer slides are typically installed along the recessed bottom surface of the drawer. To make such a design functional, an opening in the back wall of each drawer must be created through which the cabinet channel extends through to the back of the cabinet where it is supported. Otherwise the slide and channel would have to be mounted to be positioned beneath the underside edge of the drawer walls, thereby requiring even more space between the bottom of the drawer and the cabinet opening. The additional step of creating notches in the drawer is both burdensome and costly to the furniture or cabinet manufacturer.

An additional concern for both of the discussed under-mounted systems is that they may result in excessive waste of drawers and slides due to the increased likelihood of installing a slide on the wrong side of the drawer. The drawer slides are not reversible, having both a right hand slide and a left hand slide and corresponding channels. Typically, assembled base drawers are supplied with two side panels, a front panel, a rear panel and a bottom panel, but do not include the actual finished face of the drawer. Therefore, they are generally reversible, and either end could be the front or back of the finished drawer, depending on whether a left or right handed slide is attached first. However, once the notches are created in the back underside of the drawer, it is no longer a reversible drawer. Therefore, the appropriate slide must be attached to the correct side of the drawer or the drawer and the incorrectly installed drawer slide are generally scrapped.

SUMMARY OF THE INVENTION

The present invention is an under mounted drawer slide system that provides smooth insertion and withdrawal of a drawer into and out of a cabinet, while also eliminating visibility of components and avoiding the need for larger gaps between the bottom of the drawer and the opening in the cabinet.

The drawer slide assembly disclosed herein includes a cabinet channel mounted within the cabinet and a drawer slide mounted on the lower edge of the drawer along each side panel. The cabinet channel is generally C-shaped with its opening facing its corresponding drawer slide. The channel itself is of a low profile in order to minimize clearance problems, while also is deep enough to provide for a wider elongated roller on the drawer slide to travel along the channel. At the front end of the channel assembly is a mounting bracket that includes a channel roller to guide and support the drawer along the drawer slide.

Each drawer slide has a roller track surface that extends longitudinally beneath the drawer. The drawer slide is mounted to the drawer with the roller track surface positioned next to the drawer side panel and up within the recess created by the drawer's side panels and bottom. This roller surface is supported at the cabinet opening by the channel roller as described above. At the rearward end of the drawer slide is a mounting bracket that mounts the elongated slide roller behind and below the drawer. The lower height and smaller diameter of the slide roller thus allows the low profile cabinet channel to cooperate with the drawer slide, thereby avoiding clearance concerns between the components and the gap between the drawer and cabinet. This effectively eliminates the need for the components to be installed directly along the bottom surface of the drawer without requiring additional gaps between the underside of the drawer and the cabinet opening. Preferably the elongated slide roller projects inwardly from the slide toward the opposed slide roller, and thus does not protrude out past the drawer sidewall. In order to fully avoid having to create an opening through the lower edge of the rear drawer panel, the drawer slide bracket itself is formed toward the rearward end with a recurved bend to fit around the lower edge of the rear drawer panel to further secure the drawer slide and provide for the elongated slide roller. This recurved structure eliminates the necessity of cutting notches into the drawer rear panel for access by the channel.

Because the slide roller is elongated within the channel, the drawer slide assembly is capable of supporting greater loads than a traditional thin roller, while providing a system that requires a minimal amount of space beneath the drawer. The elongated slide roller and channel also cooperate to minimize any rattle or play in the drawer slide system as the drawer is inserted and withdrawn from the cabinet, as compared to the traditional larger diameter thin roller.

The present invention thus provides an under-mounted drawer slide system that will not be visible when the drawer is open. The drawer slide assembly, in preferred form, includes a roller guided within a low profile cabinet channel that results in less relative vertical movement therebetween and is more compact than traditional systems. The drawer slide assembly is easily and efficiently assembled, and reduces the additional processing of the rear panel of the drawer prior to installation of the drawer slide assembly that was associated with prior assemblies.

The drawer slide assembly accomplishes this with simplified channels and slides that require fewer manufacturing processes. Another preferred aspect of the invention the drawer slide assembly allows for a wider elongated roller, thereby increasing the load support capabilities of the slide system while still providing a smooth roller system.

These and other objects, advantages and features of this invention will be recognized by one skilled in the art upon review of the following specification in conjunction with the drawings.

DESCRIPTION OF THE PREFERRED EMBODIMENT

Figure 1:
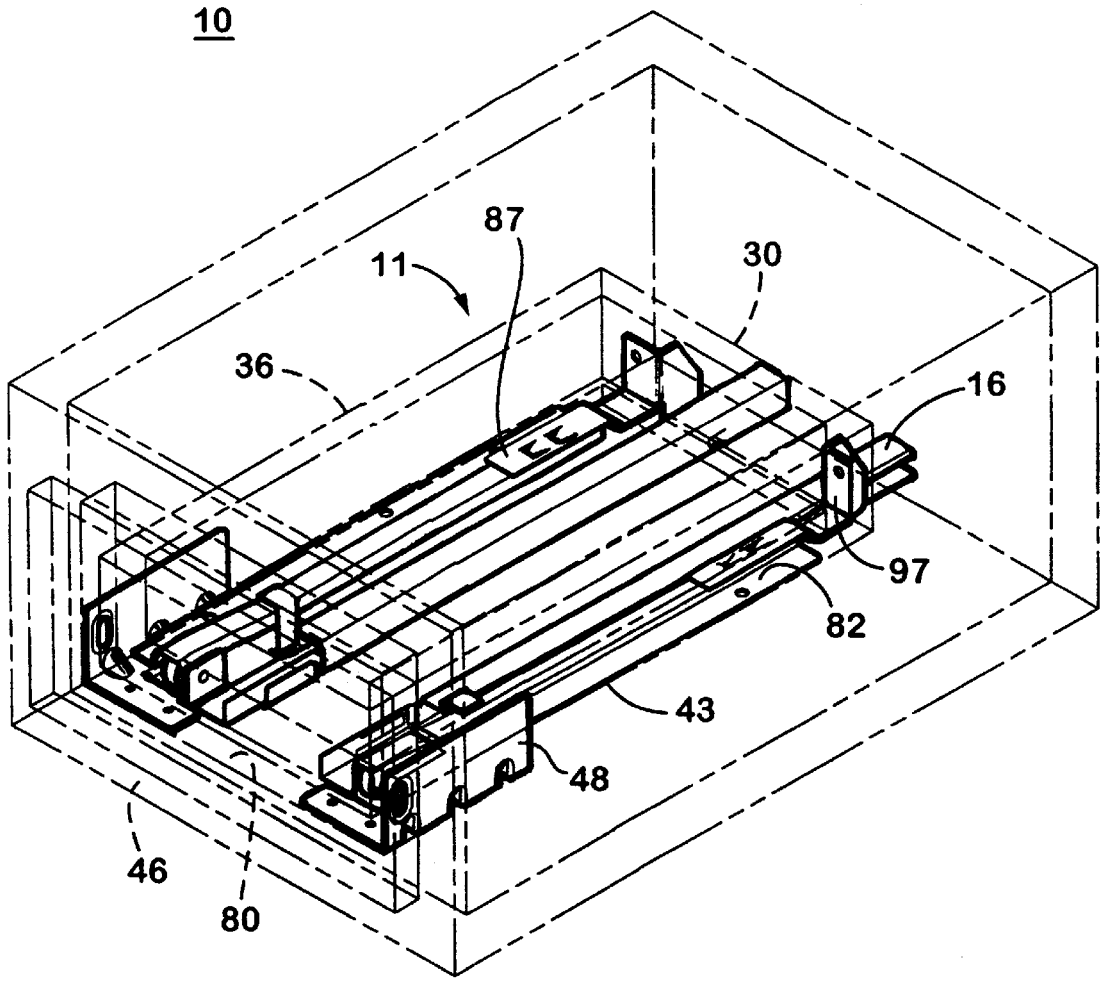
FIG. 1 is a perspective view of a drawer and cabinet with a drawer slide assembly according to the invention.

The present invention is an under-mounted drawer slide assembly 10, shown in preferred form in FIG. 1, which provides for smooth insertion and withdrawal of a drawer 11 while limiting the visibility of components when the drawer is open. This assembly includes an elongated drawer slide 12 that is secured along the underside of drawer 11 and a cooperating cabinet channel 16 that is secured within a cabinet 18, which operatively cooperate to guide and support the drawer 11. Drawer slide 12 has an elongated roller race or track 20 and includes a downward depending drawer slide roller bracket 22 at its rearward end 23. A drawer slide roller 24 is rotatably mounted on slide bracket 22 to travel along cabinet channel 16. Slide roller 24 is itself laterally elongated and is of a smaller diameter than traditional drawer slide rollers, so that slide roller 24 can travel within a low profile cabinet channel 16. Elongated slide roller 24 results in a virtually invisible under-mount drawer slide assembly that is capable of supporting greater loads while still meeting the tight space constraints beneath the drawer 11. Furthermore, roller bracket 22 is preferably formed with a bend that extends beneath and around behind the rear of drawer 11, thereby eliminating the need to "notch out" the rear of the drawers 11, resulting in improved efficiency of the drawer assembly process.

Referring now specifically to the drawings, there is shown in FIG. 1 a fully assembled and installed drawer slide assembly 10 of the preferred embodiment which includes two drawer slides 12 mounted to a drawer 11 and two cabinet channels 16 mounted within a cabinet 18. Drawer 11 has a front panel 32, a rear panel 30 and two side panels 36, all of which include a groove 38 at a predetermined height above their respective lower edges 40, (FIG. 7) 42, (FIG. 6) and 43 (FIG. 1) for accepting a bottom panel 44 of drawer 11 therein. When installed, drawer 11 movably inserts through a face frame 46 of cabinet 18 and is guided and supported by slide 12 and channel 16 and their respective rollers, as further detailed below. In order to simplify the description of this invention, only one side of the assembly 10 is shown in the figures and detailed below. The other side of assembly 10 being substantially a mirror image of the side depicted.

Figure 2:
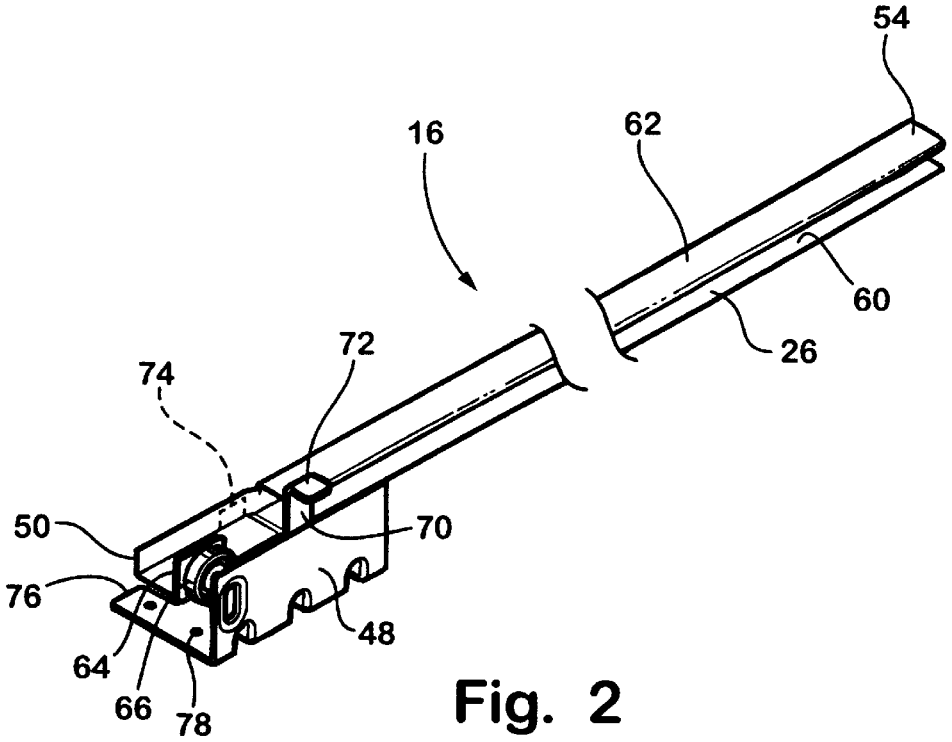
FIG. 2 is a perspective view of a cabinet channel of the preferred embodiment of the invention.
Figure 3:
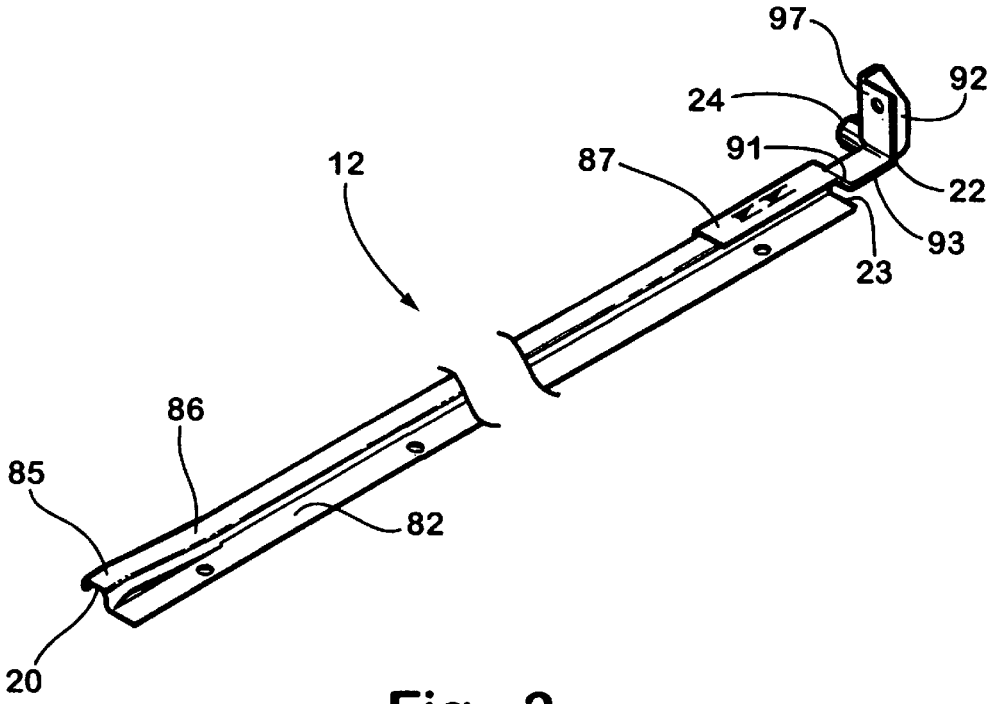
FIG. 3 is a perspective view of a drawer slide of the preferred embodiment of the invention.
Figure 4:
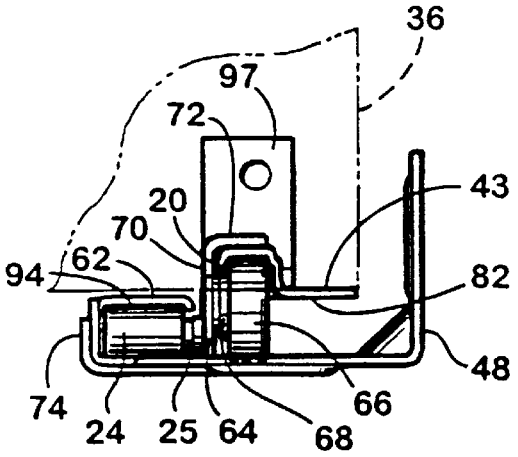
FIG. 4 is a front end view of the preferred embodiment of FIGS. 2 and 3 as installed.
Figure 5:
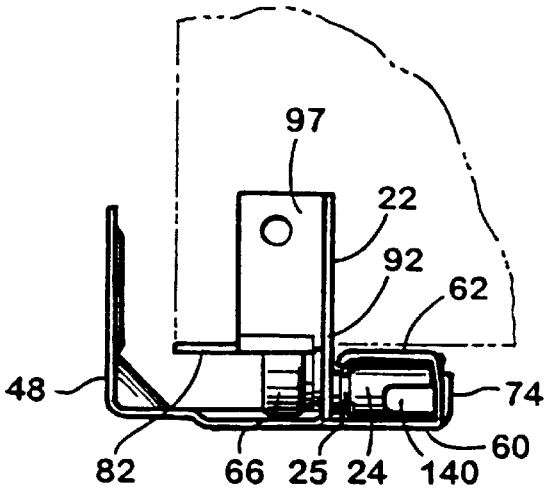
FIG. 5 is a rearward view of the preferred embodiment of FIG. 4 as installed.

Cabinet channel 16 is an elongated channel race with a C-shaped channel body 26. Cabinet channel 16 is secured within cabinet 18 by a one piece stamped flange or bracket 48 at its front end 50 which is mounted on the face frame 46 of cabinet 18 and a socket (not shown) or other means for supporting its rearward end 54 within cabinet 18. As best shown in FIG. 2, channel body 26 itself is substantially C-shaped in cross section with a lower elongated channel surface 60 extending the entire length of channel 16 and an upper elongated channel surface 62 which terminates at a predetermined distance from front end 50 to ease the installation and removal of drawer 11. At a predetermined distance from front end 50 of channel 16 is an in-stop tab 140 (FIG. 5) protruding into channel body 26, which functions to prevent over-insertion of drawer 11, as discussed below.

At front end 50 of channel 16, bracket 48 includes a vertical extension or tab 64 extending upward therefrom, upon which a channel roller 66 is rotatably mounted via a roller pin 68. Roller tab 64 and channel roller 66 are located outboard of channel 16 such that tab 64 is directly adjacent the opening of channel body 26 with roller 66 being mounted on the side of tab 64 that is opposite the channel 16. Additionally, bracket 48 includes a second vertical extension that acts as a drawer slide retainer 70, which is located rearward of roller tab 64 and channel roller 66. This retainer 70 is also adjacent channel body 26 and further includes a horizontal projection or overhang 72 projecting away from channel 16 and toward the face frame 46. A third vertical tab 74 may also extend from the inward edge 76 of bracket 48 to assist in securing bracket 48 to channel 16. Bracket 48 further includes a set of mounting holes 78 for securing bracket 48 on inner surface 80 of face frame 46 of cabinet 18. Alternately, a similar bracket could be adapted to secure the channel 16 to the sides or bottom of a cabinet that does not have a face frame around the drawer opening (not shown).

Drawer slide 12 is mounted to the drawer 11 by securing an elongated flange or mounting surface 82 along substantially the entire lower edge 43 of each side 36 of the drawer 11. Drawer slide roller track 20 runs generally parallel to mounting surface 82, and at a height there above, such that slide track 20 is positioned within a recessed cavity, shown generally as 84, formed by bottom panel 44 and side panels 36 of drawer 11. Toward the front end 85 of roller track 20, track 20 has a curved portion 86 that curves upward to provide a stay-closed feature to the drawer slide assembly 10, as discussed below.

Figure 6:
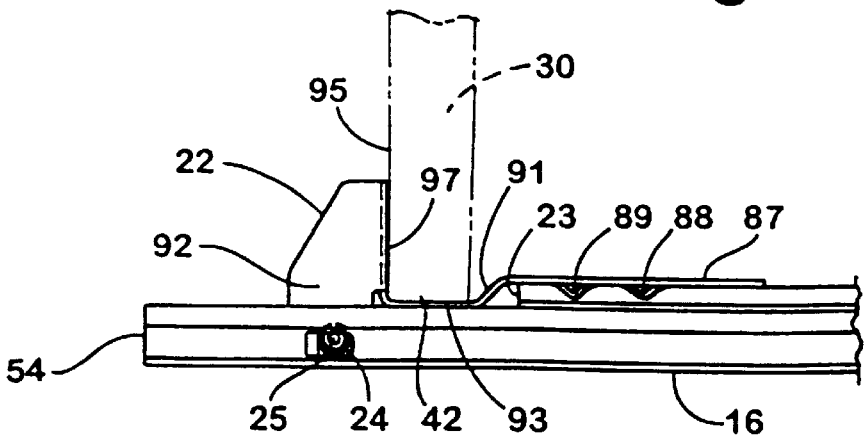
FIG. 6 is a side view of the rear portion of the drawer slide assembly of the preferred embodiment of FIG. 4.

As noted briefly above, drawer slide 12 further includes drawer slide bracket 22 on which elongated slide roller 24 is rotatably mounted by a roller pin 25. Drawer slide bracket 22 is attached to rearward end 23 of drawer slide 12 by welding or otherwise rigidly securing the components together. As best shown in FIG. 6, a horizontal mounting extension 87 on slide bracket 22 mounts atop drawer slide 12 and has two downward protruding tabs 88 and 89 that extend through two corresponding slots 90 in rearward end 23 of drawer slide 12. These tabs 88 and 89 assist in securing slide bracket 22 to drawer slide 12 and also act as out-stops when drawer 11 is fully withdrawn, as discussed below. Immediately rearward of mounting extension 87, slide bracket 22 is formed about the lower portion of rear panel 30 in order to avoid the need for an opening in therethrough. Slide bracket 22 is thus formed to have a downward depending section 91 extending from mounting extension 87 to lower edge 42 of rear panel 30 and a horizontal under wall 93 extending longitudinally across lower edge 42 to a rearward face 95 of rear panel 30. At rearward face 95, slide bracket 22 has a rear mounting tab or flange 97 that extends upward along rearward face 95 for securing slide bracket 22 to drawer 11. Depending section 91, under wall 93 and rear mounting tab 97 combine to form a wall seat to receive the lower portion of rear panel 30 therein.

Slide bracket 22 further includes a roller mounting extension 92 extending longitudinally rearward from mounting tab 97 and depending downward from rear panel 30 of drawer 11. At a point below lower edge 42 of rear panel 30, slide roller 24 is rotatably mounted to slide bracket 22, such that the outer surface 94 of roller 24 is located entirely beneath the lower edges of drawer 11 and that roller 24 extends laterally inwardly from its corresponding side 36 of drawer 11. By forming slide bracket 22 in such a fashion and mounting roller 24 below the lower edges of drawer 11, the assembly process is greatly simplified. There is no longer a need to first notch the rear of the drawer so that the cabinet channel and slide can fit within the rather tight space constraints beneath the drawer, and furthermore there is no longer a concern that a left hand drawer slide will be installed on the right hand side of the drawer, resulting in the entire drawer being scrapped.

In the preferred embodiment, slide roller 24 is of a smaller diameter than conventional rollers and is elongated so as to also have a greater width than conventional rollers, thereby providing a widened roller contact surface. Preferably, the ratio of diameter to width of slide roller 24 is less than 4:3. More preferably, the ratio is less than 1:1. Most preferably, this ratio of diameter to width is 3:4.

Once cabinet channel 16 and drawer slide 12 are both secured to cabinet 18 and drawer 11, respectively, drawer 11 is inserted into cabinet 18 such that drawer slides 12 and corresponding cabinet channels 16 effectively cooperate to guide and support drawer 11 within cabinet 18. Slide roller 24 travels within the C-shaped channel body 26, thereby guiding and supporting the rearward portion of drawer 11, while channel roller 66 rolls along slide track 20, thereby guiding and supporting the front portion of drawer 11. The horizontal projection 72 of drawer slide retainer 70 extends over roller track 20 to prevent drawer 11 from being lifted upward during use.

Figure 5A:
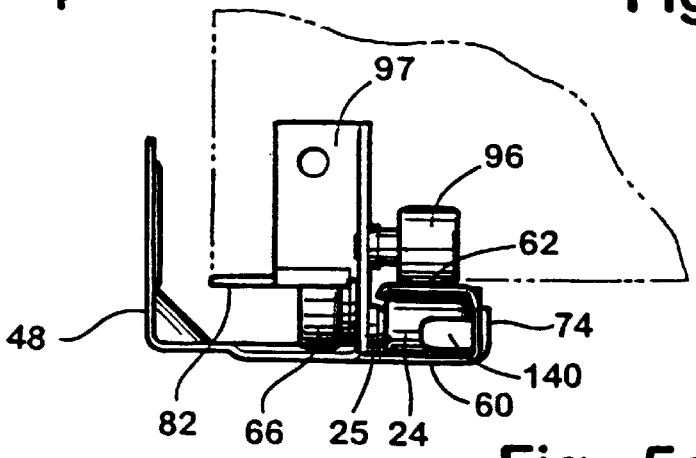
FIG. 5*a* is an alternate embodiment of the drawer slide having a second roller mounted to the drawer slide bracket.

The diameter of the slide roller 24 is slightly smaller than the distance between upper and lower channel flanges 62 and 60 so that roller 24 freely rolls therealong while practically eliminating vertical movement of the rear portion of drawer 11. In an alternate embodiment, as shown in FIG. 5*a*, a second upper slide roller 96 may be rotatably mounted to slide roller bracket 22 above the elongated slide roller 24. Upper slide roller 96 provides additional support and stability to the rear of drawer 11 as upper roller 96 rolls in contact with upper flange 62 above cabinet channel 16.

When drawer 11 is withdrawn from cabinet 18, channel roller 66 rolls along roller track 20 until it contacts the forward most tab 88 on slide bracket 22, which extends downward through the track surface. Tab 88 acts as an outer stop for the drawer 11, preventing accidental removal of the drawer from cabinet 18. If drawer 11 is then pulled further, channel roller 66 will continue until it rests between the two tabs 88 and 89, tabs 88 and 89 thus provide a locked outward position of drawer 11, so that drawer 11 is held stationary while in its outward most position for ease of access to the contents within drawer 11.

Conversely, as drawer 11 is inserted into cabinet 18, channel roller 66 rolls along roller track 20 until it contacts the upwardly curved portion 86 of track 20. At that point, drawer 11 will automatically complete the closing process due to gravity acting on the drawer, causing roller 66 to continue rolling along the curved portion 86 until drawer 11 is completely closed. This "stay closed" feature of drawer slide assembly 10 prevents drawer 11 from being left partially open when not in use.

As drawer 11 is inserted into cabinet 18, slide roller 24 approaches the in stop tab 140 protruding into channel 26. Slide roller 24 contacts the in stop tab 63 when drawer 11 is fully inserted into cabinet 18. In stop tab 140 thereby prevents over insertion of drawer 11 in cabinets where the finished drawer does not include a face plate (not shown) that overlaps the face frame 46 of cabinet 18.

A significant advantage of this invention is that it provides a compact drawer slide assembly in which the components directly interface, without the need for additional flanges and brackets. Furthermore, because no opening is made in the lower edge of the rear drawer panel, fewer steps are required to assemble the drawer and it is less likely that the wrong sided drawer slide will be installed, thereby reducing waste of drawers. These advantages result in reduced costs in both the manufacturing of the components as well as in the assembly of the finished cabinet.

Figure 7:
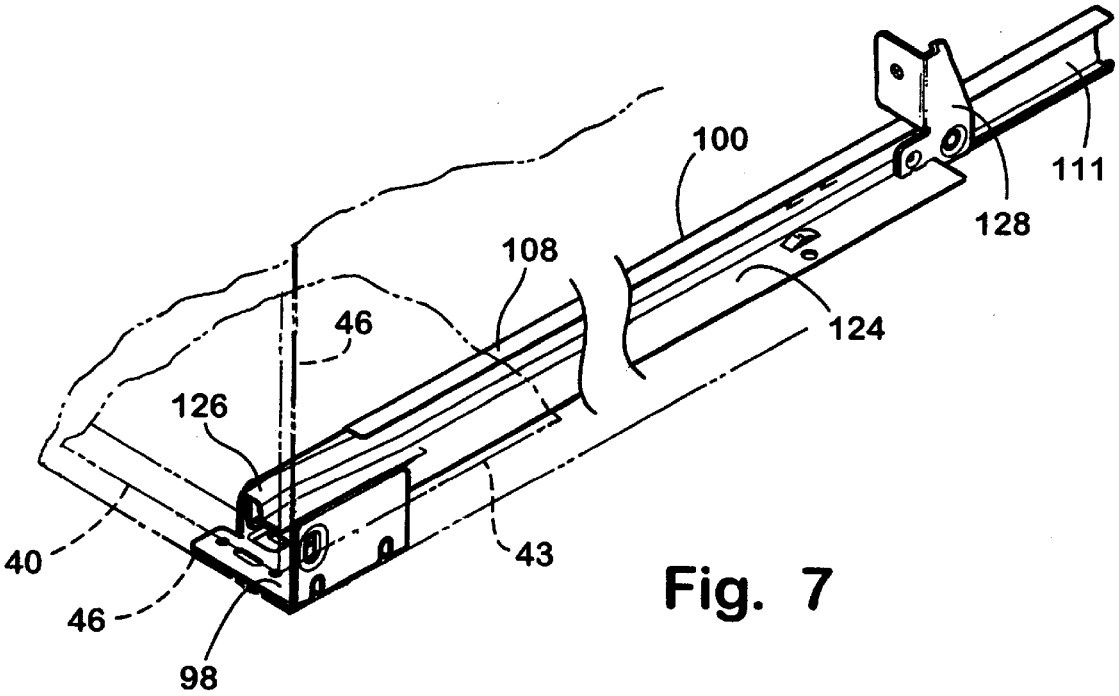
FIG. 7 is a perspective view of a drawer slide assembly of an alternate embodiment of the present invention.
Figure 10:
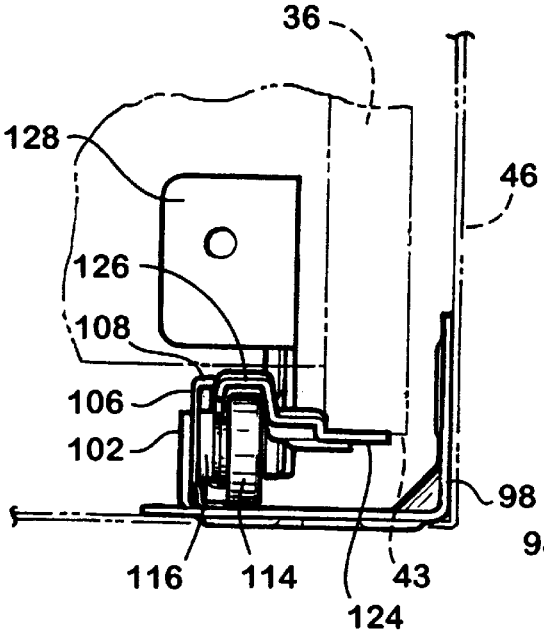
FIG. 10 is a front end view of the alternate embodiment of FIG. 7 as installed.
Figure 11:
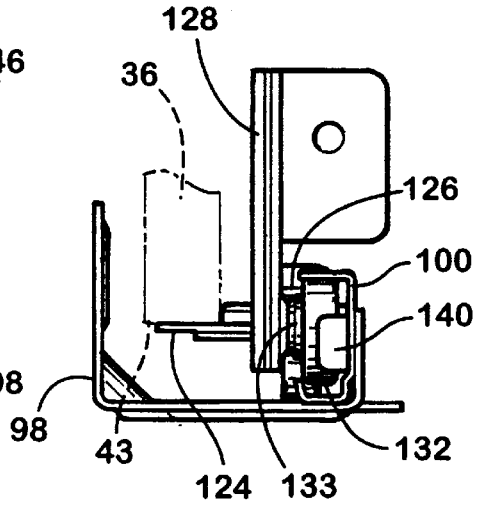
FIG. 11 is a rearward view of the alternate embodiment of FIG. 7 as installed.
Figure 8:
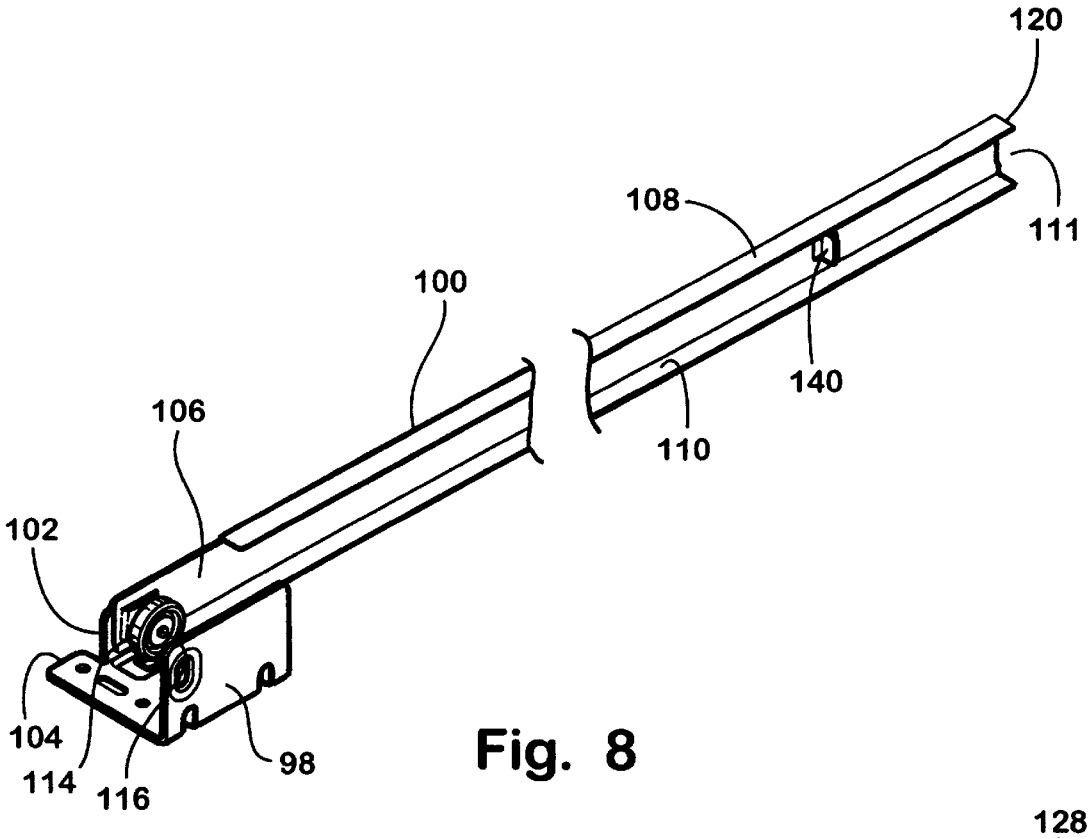
FIG. 8 is a perspective view of the alternate cabinet channel of FIG. 7.

In an alternate embodiment of the invention, shown in FIGS. 7 and 8 a channel bracket 98 is secured to a channel 100 and face frame 46. Channel bracket 98 has only one vertical mounting tab 102, extending upward from its inner edge 104, which attaches on the side 106 of channel 100. Channel 100 is again a generally C shaped channel extending longitudinally into cabinet 18 with an upper surface 108 and a lower surface 110 that define an opening 111. Both upper and lower surfaces 108 and 110 terminate at predetermined distances from the front end 112 of cabinet channel 100 to provide clearance for a channel roller 114 and to ease insertion and removal of drawer 11. Channel roller 114 rotatably mounts on a roller pin 116 extending through the side 106 of channel 100 and into mounting tab 102. Channel roller 114 is located so that it is generally within the channel opening 111 itself, but could extend below the lower surface 110 without affecting the performance of the drawer slide assembly. An in-stop tab 140 protrudes into channel opening 111 to prevent over insertion of drawer 11 as discussed above. The alternate embodiment further includes a socket (not shown) or other means for supporting its rearward end 120 within cabinet 18.

Figure 9:
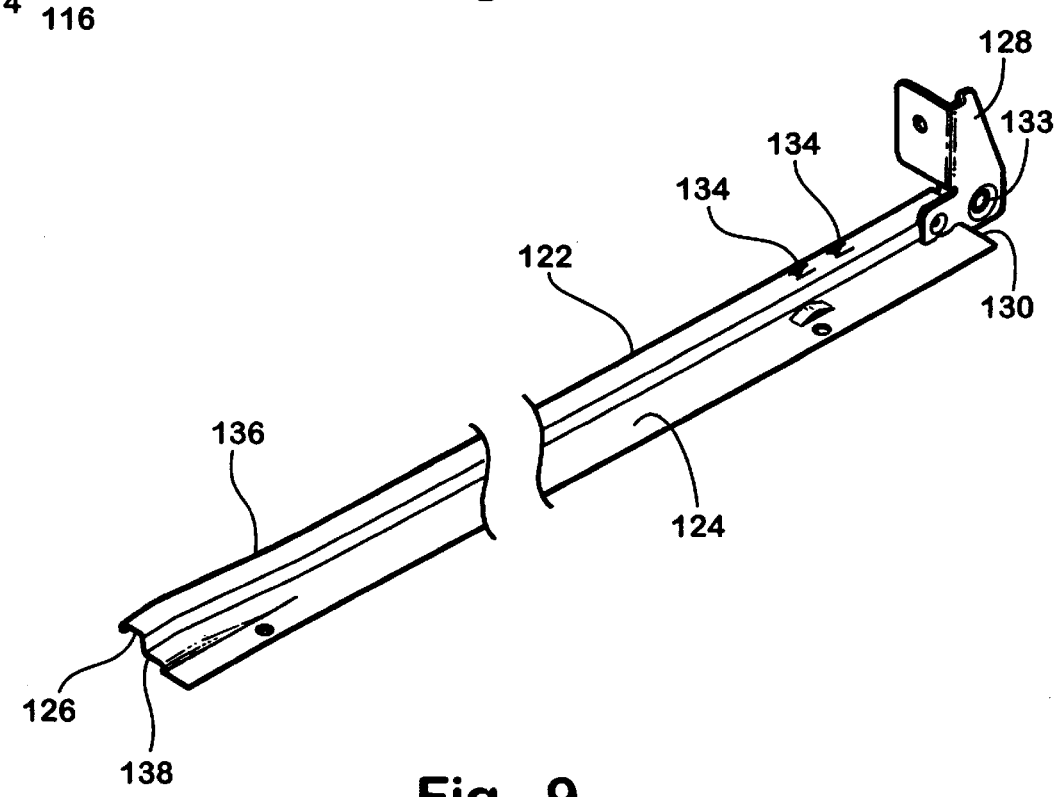
FIG. 9 is a perspective view of the alternate drawer slide of FIG. 7.

The corresponding drawer slide 122 of the alternate embodiment is shown in FIG. 9. This slide 122 also has a mounting surface 124 for securing drawer slide 122 along lower edge 43 of side drawer panels 36 and a roller track 126, similar to the preferred embodiment. A roller bracket 128 is secured to the rearward end 130 of drawer slide 122 which includes a slide roller 132 rotatably mounted to a roller pin 133 secured to roller bracket 128. Slide roller 132 is mounted laterally inward of roller bracket 128 so as to be generally rearward of the roller track 126. Roller track 126 further includes two detentes 134 that are located at a predetermined distance from rearward end 130 of roller track 126 and are formed by downward perforations in the track 126. An upwardly curved portion 136 is also located at the forward end 138 of track 126. Detentes 134 and curved portion 136 function as out-stops and stay closed features, respectively, in a similar manner as discussed above for the preferred embodiment.

When the alternate embodiment is fully assembled, roller track 126 of drawer slide 122 inserts along cabinet channel 100, so that upper channel surface 108 prevents upward movement of drawer 11 in similar manner as drawer slide retainer 70 in the preferred embodiment. Channel roller 114 rolls along roller track 126, thereby guiding and supporting the front portion of drawer 11, while slide roller 132 rolls within channel 100 in contact with lower channel surface 110, thereby guiding and supporting the rear portion of the drawer 11.

Because roller track 126 of the alternate embodiment actually inserts within channel opening 117, there is not enough space between the lower edges of drawer 11 and the cabinet opening for the cabinet channel to be mounted entirely beneath the lower edges of the drawer panels. Therefore, this embodiment requires that an opening be created in the lower edge 42 of rear panel 30, which cabinet channel 100 and drawer slide 122 then pass through. However, because this embodiment utilizes a C-shaped channel opening toward drawer slide 122, an elongated slide roller similar to the preferred embodiment is implemented to provide additional support and stability to the drawer slide assembly. Furthermore, while this embodiment does not avoid the requirement of notching the rear panels of the drawer, it does provide for simplified manufacturing of the components due to the direct interface between the drawer slide and cabinet channel and the simplified mounting brackets secured thereto.

Changes and modifications in the specifically described embodiments can be carried out without departing from the principles of the invention, which is intended to be limited only by the scope of the appended claims, as interpreted according to the principles of patent law.

What is claimed is:

1. An under drawer slide assembly for mounting to a furniture article with a drawer, the drawer having a bottom and a rear wall with a lower region depending beneath said bottom, comprising:

a channel member having an elongated channel body with a channel race therealong a channel mounting flange adapted to mount said elongated body on said furniture article beneath said drawer, and a channel roller rotatably coupled to said channel body;

a drawer slide having an elongated slide body forming a slide race therealong adapted to extend beneath said bottom of said drawer, a wall seat disposed at a rear region of said slide body extending longitudinally rearward therefrom, said wall seat defining an upwardly opening generally U-shaped drawer wall receiving portion which is dimensioned to receive the lower region of said drawer rear wall therein, a slide roller rotatably coupled to said drawer slide adjacent said wall seat, and a mounting flange adapted to mount said drawer slide to said drawer with said slide race extending beneath said drawer and said drawer rear wall received in said wall seat;

said drawer slide mating with said channel member, said slide roller contacting said channel race and said channel roller contacting said slide race.

2. The under drawer slide assembly of claim 1 wherein said slide roller having a widened roller contact surface relative a reduced diameter so as to provide a diameter to width ratio less than 1:1.

3. The under drawer slide assembly of claim 1, wherein said wall seat comprises a slide roller flange and said mounting flange, said slide roller flange extending rearwardly from said wall seat, said slide roller being rotatably coupled to said slide roller flange.

4. The under drawer slide assembly of claim 1, wherein said slide roller is rotatably coupled to said drawer slide rearward of said slide body.

5. An under drawer slide assembly for mounting to a furniture article with a drawer, the drawer having a bottom and a rear wall with a lower region depending beneath said bottom, comprising:

a channel member having an elongated channel body with a channel race therealong, a channel mounting flange adapted to mount said elongated body on said furniture article beneath said drawer, and a channel roller rotatable coupled to said channel body;

a drawer slide having an elongated slide body forming a slide race therealong adapted to extend beneath said bottom of said drawer, a wall seat disposed at a rear region of said slide body extending longitudinally rearward therefrom, said wall seat dimensioned to receive said drawer rear wall therein, a slide roller flange disposed rearward of said wall seat and a slide roller rotatably coupled to said slide roller flange, an upper slide roller rotatably coupled to said slide roller flange, said upper slide roller positioned above said slide roller such that said upper slide roller contacts an upper surface of said channel race, and a mounting flange adapted to mount said drawer slide to said drawer with said slide race extending beneath said drawer and said drawer rear wall received in said wall seat;

said drawer slide mating with said channel member, said slide roller contacting said channel race and said channel roller contacting said slide race.

6. An under drawer slide assembly for mounting to a furniture article with a drawer, the drawer having front, rear and side walls and a bottom defining an underside recess beneath the bottom, comprising:

a channel member having an elongated channel body with a channel race therealong, a channel mounting flange adapted to mount said elongated body on said furniture article beneath said drawer, and a channel roller rotatable coupled to said channel body;

a drawer slide having an elongated slide body forming a slide race therealong, adapted to extend beneath said bottom of said drawer, an elongated slide mounting flange adapted to mount said drawer slide to extend beneath said drawer and extend said slide race upward into said recess, said slide mounting flange adapted to secure under and along said side wall of said drawer, and a slide roller rotatable coupled to said slide body;

said drawer slide mating with said channel member, said drawer slide and channel body adapted so that said slide roller and said channel roller rotate on parallel axes that are laterally offset from each other, said slide roller contacting said channel race and said channel roller contacting said slide race, said drawer slide further including a wall seat extending longitudinally rearward from a rear region of said slide body, said wall seat dimensioned to receive said drawer rear wall therein, a slide roller flange disposed rearward of said wall seat and a slide roller rotatably coupled to said slide roller flange, and a rear mounting flange adapted to mount said drawer slide to said drawer with said slide race extending beneath said drawer and said drawer rear wall received within said wall seat.

7. The under drawer slide assembly of claim 6 further including a retaining flange protruding upward from said channel mounting flange, said retaining flange adapted to extend above said slide body of said drawer slide and prevent upward movement thereof.

8. The under drawer slide assembly of claim 6 wherein said slide roller having a widened roller contact surface relative a reduced diameter so as to provide a diameter to width ratio less than 1:1.

9. An under drawer slide assembly for mounting to a furniture article with a drawer, the drawer having a bottom and a rear wall with a lower region depending beneath the bottom, comprising:

a channel member comprising an elongated channel body with a channel race therealong, a channel mounting flange adapted to mount said elongated body on the furniture article beneath the drawer, and a channel roller rotatably coupled to said channel body; and a drawer slide comprising an elongated slide body forming a slide race therealong adapted to extend beneath the bottom of the drawer, a slide roller flange disposed toward a rearward end of said slide body, a lower slide roller rotatably coupled to said slide roller flange, an upper slide roller rotatably coupled to said slide roller flange, and a mounting flange adapted to mount said drawer slide to the drawer with said slide race extending beneath the drawer, wherein said drawer slide mates with said channel member, said lower slide roller engaging said channel race and said channel roller engaging said slide race, said upper slide roller being positioned at a height greater than said lower slide roller such that said upper slide roller engages an upper surface of said channel member.

10. The under drawer slide assembly of claim 9, wherein said drawer slide further comprises a wall seat disposed adjacent said rearward end of said slide body, said wall seat dimensioned to receive the drawer rear wall therein.

11. The under drawer slide assembly of claim 10, wherein said wall seat defines a generally U-shaped receiving portion to receive the lower region of the drawer rear wall.

12. The under drawer slide assembly of claim 10, wherein said wall seat comprises said slide roller flange and said mounting flange.

13. The under drawer slide assembly of claim 9, wherein said lower slide roller has a widened roller contact surface relative to a reduced diameter so as to provide a diameter to width ratio of less than 1:1.

14. The under drawer slide assembly of claim 9, wherein said slide roller flange extends rearwardly of said slide body.

* * * * *

UNITED STATES PATENT AND TRADEMARK OFFICE

CERTIFICATE OF CORRECTION

PATENT NO. : 6,142,596
DATED : November 7, 2000
INVENTOR(S) : Sharon M. Carson

It is certified that error appears in the above-identified patent and that said Letters Patent is hereby corrected as shown below:

Column 4,
Line 30, "40, (FIG. 7) 42, (FIG. 6)" should be -- 40 (FIG. 7), 42 (FIG. 6), --

Column 6,
Line 45, "63" should be -- 140 --

Column 8,
Line 7, insert -- , -- after "therealong"
Lines 46 and 47, "rotatable" should be -- rotatably --

Column 9,
Lines 8 and 9, "rotatable" should be -- rotatably --
Line 17, "rotatable" should be -- rotatably --

Signed and Sealed this

Seventeenth Day of June, 2003

JAMES E. ROGAN
*Director of the United States Patent and Trademark Office*